US009298115B2

(12) United States Patent
Kuno et al.

(10) Patent No.: US 9,298,115 B2
(45) Date of Patent: Mar. 29, 2016

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Junpei Kuno, Mishima (JP); Takeshi Murakami, Numazu (JP); Tsutomu Nishida, Mishima (JP); Masataka Kawahara, Mishima (JP); Kaname Watariguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 14/263,908

(22) Filed: Apr. 28, 2014

(65) Prior Publication Data

US 2014/0322637 A1 Oct. 30, 2014

(30) Foreign Application Priority Data

Apr. 30, 2013 (JP) ..... 2013-095611
Mar. 13, 2014 (JP) ..... 2014-050808

(51) Int. Cl.

| | |
|---|---|
| ***G03G 5/04*** | (2006.01) |
| ***G03G 5/06*** | (2006.01) |
| ***G03G 5/05*** | (2006.01) |

(52) U.S. Cl.
CPC ..... *G03G 5/0696* (2013.01); *G03G 5/0542* (2013.01); *G03G 5/0603* (2013.01); *G03G 5/0607* (2013.01); *G03G 5/0609* (2013.01); *G03G 5/0612* (2013.01)

(58) Field of Classification Search
CPC . G03G 5/0603; G03G 5/0607; G03G 5/0609; G03G 5/0612; G03G 5/0696; G03G 5/0542
See application file for complete search history.

(56) References Cited

U.S. PATENT DOCUMENTS

2011/0143277 A1* 6/2011 Shiotari ..... G03G 9/0815 430/110.3

FOREIGN PATENT DOCUMENTS

| | | |
|---|---|---|
| JP | 2006-072304 A | 3/2006 |
| JP | 2008-015532 A | 1/2008 |

* cited by examiner

*Primary Examiner* — Peter Vajda
(74) *Attorney, Agent, or Firm* — Canon U.S.A. Inc., IP Division

(57) ABSTRACT

In an electrophotographic photosensitive member including a charge-generating layer, the charge-generating layer has a matrix-domain structure; in the matrix-domain structure, the domain contains a charge-generating substance, and the matrix contains a binder resin and a fluoranthene compound.

12 Claims, 4 Drawing Sheets

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method for manufacturing the electrophotographic photosensitive member, a process cartridge, and an electrophotographic apparatus.

2. Description of the Related Art

Electrophotographic photosensitive members used in electrophotographic apparatuses, such as a copying machine and a laser beam printer, need to have a sensitivity adequate for light to which images are exposed. It is known that azo pigments and phthalocyanine pigments used as charge-transporting substances exhibit high sensitivity to light in a broad wavelength range.

In recent years, images of high quality, such as high-quality color images, have been demanded. Half-tone images, such as a picture, and solid images are widely used, and the quality of such images has been enhanced year by year. In recent years, tolerance for a phenomenon called "positive ghost image" has been significantly narrowed; in the phenomenon, the density of the limited part of a half-tone image corresponding to the light-irradiated part of an electrophotographic photosensitive member becomes strong at the subsequent rotation of the electrophotographic photosensitive member in formation of one image. It is believed that such a ghost image is generated for the following reason: holes which are a type of carriers (electrons and holes) generated from a charge-generating substance are injected into a charge-transporting layer, and then electrons are likely to remain in the charge-generating layer to cause a transfer memory.

Japanese Patent Laid-Open No. 2006-72304 discloses a technique in which a charge-generating layer contains a composite of a phthalocyanine pigment and an organic electron acceptor compound to reduce generation of defective images such as a ghost image. Japanese Patent Laid-Open No. 2008-15532 discloses a technique in which a charge-generating layer contains a pigment-sensitizing dopant having electron acceptor molecules to reduce generation of defective images such as a ghost image.

The inventors, however, have conducted studies and found that the techniques disclosed in Japanese Patent Laid-Open Nos. 2006-72304 and 2008-15532 cause an increase in the particle size in a coating liquid for the charge-generating layer and are thus inadequate for enabling reduction in both a ghost image and a black-spot image in some cases.

SUMMARY OF THE INVENTION

The present invention provides an electrophotographic photosensitive member which enables formation of a good output image which is less likely to suffer from a ghost and a black spot; the present invention also provides a method for manufacturing the electrophotographic photosensitive member.

The present invention also provides a process cartridge and electrophotographic apparatus including such an electrophotographic photosensitive member.

An aspect of the present invention provides an electrophotographic photosensitive member including: a support; a charge-generating layer formed on the support; and a charge-transporting layer formed on the charge-generating layer, wherein the charge-generating layer has a matrix-domain structure having: a domain which comprises the charge-generating substance, and a matrix which comprises a binder resin and a fluoranthene compound.

Another aspect of the present invention provides a process cartridge including: the above-mentioned electrophotographic photosensitive member; and at least one unit selected from the group consisting of a charging unit, a developing unit, and a cleaning unit, wherein the process cartridge integrally holds the electrophotographic photosensitive member and the selected unit and is removably attached to the main body of an electrophotographic apparatus.

Another aspect of the present invention provides an electrophotographic apparatus including: the above-mentioned electrophotographic photosensitive member; a charging unit; an exposure unit; a developing unit; and a transfer unit.

Another aspect of the present invention provides a method for manufacturing an electrophotographic photosensitive member including a support, a charge-generating layer formed on the support, and a charge-transporting layer formed on the charge-generating layer, the method including: mixing a charge-generating substance, a binder resin, and a solvent with each other to prepare a dispersion liquid; adding a fluoranthene compound to the dispersion liquid to prepare a coating liquid for the charge-generating layer; and forming the charge-generating layer through forming a coating film of the coating liquid for the charge-generating layer and then heat-drying the coating film.

Some aspects of the present invention can provide an electrophotographic photosensitive member which can reduce a ghost image and a black-spot image and also provide a method for manufacturing the electrophotographic photosensitive member. Some aspects of the present invention can provide a process cartridge and electrophotographic apparatus including such an electrophotographic photosensitive member.

Further features of the present invention will become apparent from the following description of exemplary embodiments with reference to the attached drawings.

DESCRIPTION OF THE EMBODIMENTS

Figure 1:
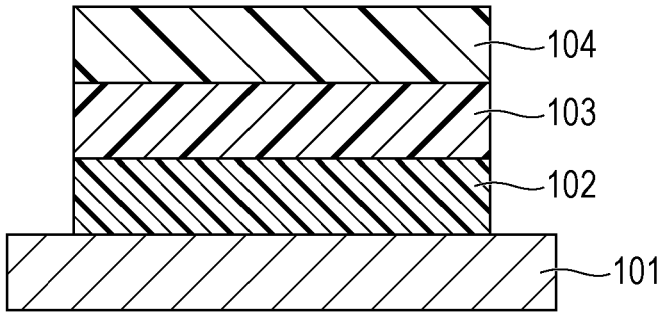
FIG. 1 illustrates the structure of an electrophotographic photosensitive member according to an embodiment of the present invention.

The electrophotographic photosensitive member of the present invention includes a support, a charge-generating layer formed so as to overlie the support, and a charge-transporting layer formed so as to overlie the charge-generating layer. FIG. 1 illustrates an example of the layered structure of the electrophotographic photosensitive member. In FIG. 1, an undercoat layer 102, a charge-generating layer 103, and a charge-transporting layer 104 are formed in sequence so as to overlie a support 101.

In the present invention, the charge-generating layer has a matrix-domain structure; the domain contains a charge-generating substance, and the matrix contains a binder resin and a fluoranthene compound.

<Fluoranthene Compound>

The fluoranthene compound contained in the matrix of the charge-generating layer is unsubstituted fluoranthene having a structure represented by Formula (1) [Example Compound (1)] or a fluoranthene derivative having a substituent on its ring. Alternatively, the fluoranthene compound is unsubstituted benzofluoranthene having a structure represented by any of Formulae (2) to (5) [Example Compounds (2), (28), (29), and (30), respectively] or a benzofluoranthene derivative having a substituent on its ring.

(1)

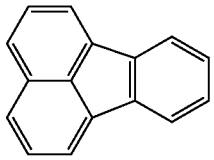

(2)

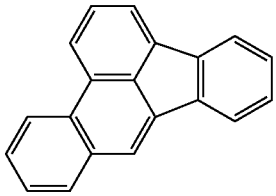

(3)

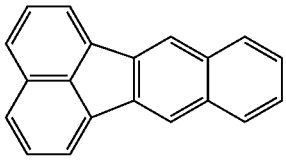

(4)

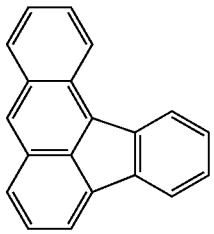

(5)

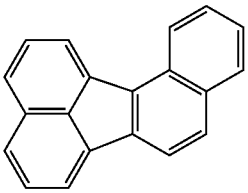

In particular, the fluoranthene compound can be a compound represented by Formula (6) or (7) in terms of a reduction in a ghost:

(6)

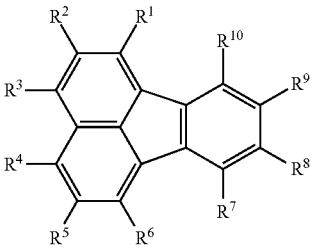

-continued (7)

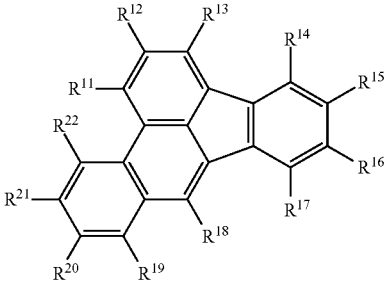

(in Formulae (6) and (7), $R^1$ to $R^{22}$ each independently represent a hydrogen atom, a halogen atom, a nitro group, an aldehyde group, a substituted amino group, a substituted or unsubstituted alkyl group, or a substituted or unsubstituted aryl group;

the substituent of the substituted amino group is an alkyl group, an alkoxy-group-substituted alkyl group, an aryl-substituted alkyl group, a halogen-substituted alkyl group, an aryl group, an alkoxy-group-substituted aryl group, an aryl-group-substituted aryl group, or a halogen-substituted aryl group;

the substituent of the substituted alkyl group is an alkoxy group, a morpholinoalkoxy group, a dialkylamino group, an alkoxycarbonyl group, an aryl group, a halogen atom, a cyano group, or a morpholino group; and the substituent of the substituted aryl group is an alkyl group, an alkoxy group, a dialkylamino group, an alkoxycarbonyl group, a halogen atom, a nitro group, a cyano group, a formyl group, or a morpholino group).

Specific examples of such a fluoranthene compound include the following compounds (Example Compounds); however, the present invention is not limited thereto.

Example Compound (1)

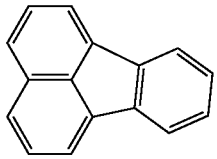

Example Compound (2)

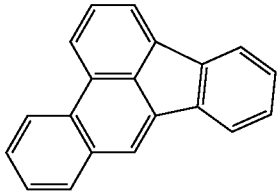

Example Compound (3)

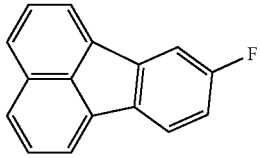

Example Compound (4)

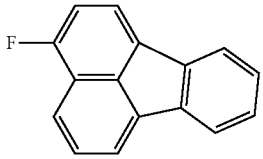

-continued
Example Compound (5)
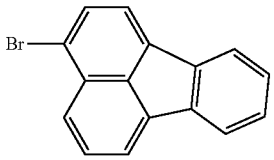
Example Compound (6)
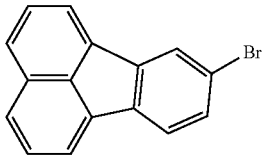
Example Compound (7)
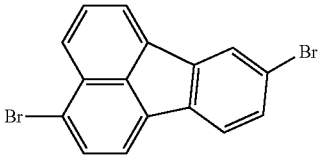
Example Compound (8)
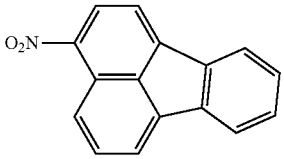
Example Compound (9)
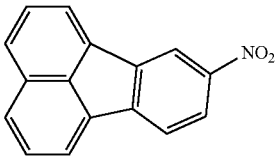
Example Compound (10)
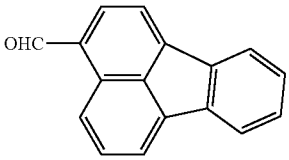
Example Compound (11)
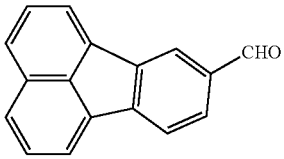
Example Compound (12)
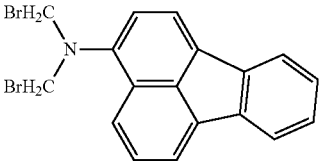
Example Compound (13)
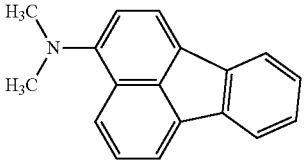
-continued
Example Compound (14)
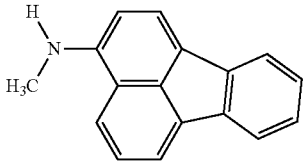
Example Compound (15)
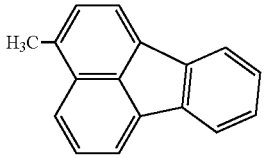
Example Compound (16)
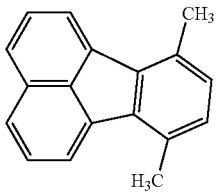
Example Compound (17)
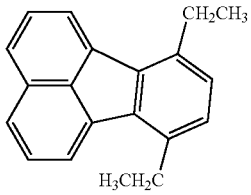
Example Compound (18)
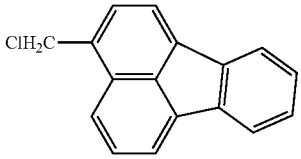
Example Compound (19)
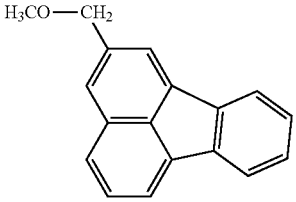
Example Compound (20)
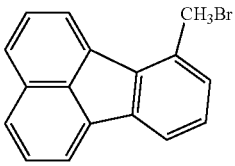
Example Compound (21)
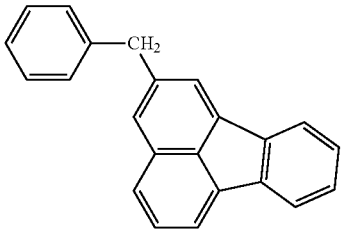

-continued

Example Compound (22)

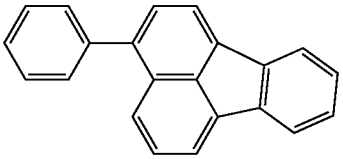

Example Compound (23)

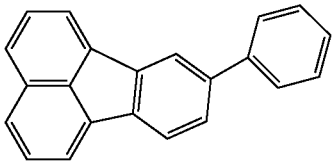

Example Compound (24)

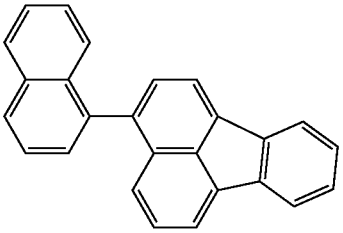

Example Compound (25)

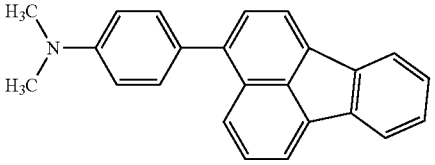

Example Compound (26)

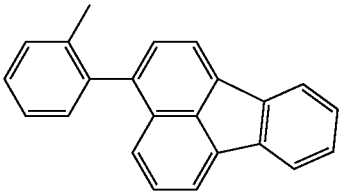

Example Compound (27)

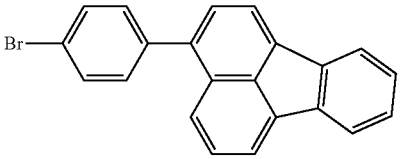

Example Compound (28)

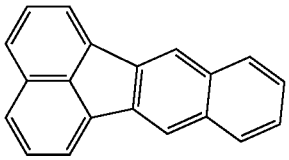

Example Compound (29)

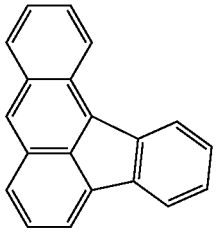

-continued

Example Compound (30)

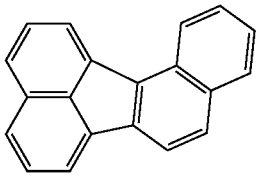

Such a fluoranthene compound (fluoranthene, fluoranthene derivative, benzofluoranthene, or benzofluoranthene derivative) contained in the matrix of the charge-generating layer serves well for a reduction in a ghost. The inventors presume that such an effect is produced for the following mechanism. The fluoranthene compound has a five-membered ring that is in a five-π-conjugated state. The presence of the five-membered ring enables electron acceptability, and the π conjugated structure formed by a contiguous electron configuration also enables good electron transportability. Since the five-membered ring structure in the fluoranthene compound is not an unstable structure that is highly reactive, generation of a black spot due to a reduction in the dispersibility of a charge-generating substance is suppressed. It is presumed that generation of a ghost and a black spot can be reduced owing to such a mechanism.

<Matrix-domain Structure>

The matrix-domain structure will now be described. When the matrix-domain structure of the present invention is compared to a "sea-island structure," the matrix corresponds to the sea, and the domain corresponds to the island. Such a matrix-domain structure can be confirmed by observing the surface or the cross-sectional surface of the charge-generating layer.

Observation of a state of the matrix-domain structure or determination of the domain structure can be carried out with, for example, a commercially available laser microscope, optical microscope, electron microscope, or atomic force microscope.

As described above, the inventors presume that the fluoranthene compound contained in the matrix of the charge-generating layer enables an enhancement in the electron transportability of the charge-generating layer and a reduction in generation of positive ghost images.

<Charge-generating Substance>

A charge-generating substance that is to be contained in the domain of the charge-generating layer can be a phthalocyanine pigment or an azo pigment because these pigments have high sensitivity. In particular, a phthalocyanine pigment can be used.

Examples of the phthalocyanine pigment include metal-free phthalocyanine and metal phthalocyanine, and these phthalocyanines may have axial ligands or substituents. Among the phthalocyanine pigments, while oxytitanium phthalocyanine crystal and gallium phthalocyanine crystal tend to cause a ghost phenomenon, they have high sensitivity which is useful in the present invention and therefore can be employed.

Furthermore, among oxytitanium phthalocyanine crystal and gallium phthalocyanine crystal, the following crystals (1) to (3) can be employed.

(1) Hydroxygallium phthalocyanine crystal having a crystalline form showing peaks at Bragg angles 2θ of 7.4°±0.3° and 28.2°±0.3° in X-ray diffraction with a CuKα ray (2) Chlorogallium phthalocyanine crystal having a crystalline form showing peaks at Bragg angles 2θ±0.2° of 7.4°, 16.6°, 25.5°, and 28.3°

(3) Oxytitanium phthalocyanine crystal having a crystalline form showing a peak at a Bragg angle 2θ of 27.2°±0.2°

Among these, the hydroxygallium phthalocyanine crystal having a crystalline form showing peaks at Bragg angles 2θ of 7.4°±0.3° and 28.2°±0.3° can be employed.

In particular, the following crystals (4) and (5) can be used.

(4) Hydroxygallium phthalocyanine crystal having a crystalline form showing peaks at Bragg angles 2θ±0.2° of 7.3°, 24.9°, and 28.1° and showing the highest peak at 28.1°

(5) Hydroxygallium phthalocyanine crystal having a crystalline form showing peaks at Bragg angles 2θ±0.2° of 7.5°, 9.9°, 16.3°, 18.6°, 25.1°, and 28.3°

<Support>

The support can be a support having a conductivity (conductive support). Specific examples thereof include supports made of metals, such as aluminum and stainless steel, and supports made of metal, plastic materials, and paper and having surfaces coated with conductive films. Examples of the form of the support include a cylinder and a film.

The undercoat layer (intermediate layer) which serves as a barrier or has adhesion can be disposed between the support and the charge-generating layer.

In order to form the undercoat layer, resin is dissolved in a solvent to prepare a coating liquid for the undercoat layer, the coating liquid is applied onto the support or onto a conductive layer which will be described later, and the resulting coating film is dried by heating. Examples of the resin used for forming the undercoat layer include polyvinyl alcohol, polyethylene oxide, ethyl cellulose, methyl cellulose, casein, and polyamide.

The thickness of the undercoat layer is preferably in the range of 0.3 μm to 5.0 μm. A conductive layer can be formed between the support and the undercoat layer to cover the unevenness or defects on the surface of the support or to reduce interference fringe.

In order to form the conductive layer, conductive particles and a binder resin are dispersed in a solvent to prepare a coating liquid for the conductive layer, and the coating liquid is applied onto the support, and the resulting coating film is dried or cured by heating. Examples of conductive particles include carbon black, metal particles, and metal oxide particles.

The thickness of the conductive layer is preferably in the range of 5 μm to 40 μm, and more preferably 10 μm to 30 μm.

<Charge-generating Layer>

The charge-generating layer can be formed through the following processes. In particular, the charge-generating layer can be formed through a process for mixing a charge-generating substance, a binder resin, and a solvent with each other to prepare a dispersion liquid, a process for adding a fluoranthene compound to the dispersion liquid to prepare a coating liquid for the charge-generating layer, and a process for forming the charge-generating layer through forming a coating film of the coating liquid for the charge-generating layer and heat-drying the coating film.

The thickness of the charge-generating layer is preferably in the range of 0.05 μm to 1 μm, and more preferably 0.1 μm to 0.3 μm.

The fluoranthene compound content is preferably in the range of 0.1 mass % to 40 mass %, and more preferably 1 mass % to 30 mass % relative to the charge-generating substance content in the charge-generating layer. The fluoranthene compound content is preferably in the range of 0.2 mass % to 80 mass %, and more preferably 2 mass % to 60 mass % relative to the binder resin content in the charge-generating layer.

The fluoranthene compound may be amorphous or crystalline. The above-mentioned fluoranthene compounds may be used in combination.

Examples of the binder resin used for the charge-generating layer include polyester, acrylic resins, phenoxy resins, polycarbonate, polyvinyl butyral, polystyrene, polyvinyl acetate, polysulfone, polyarylate, polyvinylidene chloride, acrylonitrile copolymers, and polyvinyl benzal. Among these, polyvinyl butyral can be employed.

<Charge-transporting Layer>

In order to form the charge-transporting layer, a charge-transporting substance and a binder resin are dissolved in a solvent to prepare a coating liquid for the charge-transporting layer, the coating liquid is applied onto the charge-generating layer to form a coating film, and the coating film is dried by heating.

The thickness of the charge-transporting layer is preferably in the range of 5 μm to 40 μm, and more preferably 10 μm to 25 μm.

The charge-transporting substance content is preferably in the range of 20 mass % to 80 mass %, and more preferably 30 mass % to 60 mass % relative to the total mass of the charge-transporting layer.

Examples of the charge-transporting substance include triarylamine compounds, hydrazone compounds, stilbene compounds, pyrazoline compounds, oxazole compounds, thiazole compounds, and triarylmethane compounds. Among these, triarylamine compounds can be employed.

Examples of the binder resin used for the charge-transporting layer include polyester, acrylic resins, phenoxy resins, polycarbonate, polystyrene, polyvinyl acetate, polysulfone, polyarylate, polyvinylidene chloride, and acrylonitrile copolymers. Among these, polycarbonate and polyarylate can be used.

Examples of a technique for applying the coating liquids for individual layers include dip coating (dipping), spray coating, spinner coating, bead coating, blade coating, and beam coating.

A protective layer may be formed on the charge-transporting layer to protect the charge-transporting layer. In order to form the protective layer, resin is dissolved in a solvent to prepare a coating liquid for the protective layer, the coating liquid is applied onto the charge-transporting layer, and the resulting coating film is dried or cured by heating. Examples of the rein used for forming the protective layer include polyvinyl butyral, polyester, polycarbonates (such as polycarbonate Z and modified polycarbonates), nylon, polyimide, polyarylate, polyurethane, styrene-butadiene copolymers, styrene-acrylic acid copolymers, and styrene-acrylonitrile copolymers.

In the case where the coating film is cured, the coating film can be cured by heating or by being irradiated with an electron beam or ultraviolet. The thickness of the protective film is preferably in the range of 0.05 μm to 20 μm.

The protective layer may contain lubricating particles such as conductive particles, an ultraviolet absorber, and fluorine atom-containing resin particles. Examples of the conductive particles include metal oxide particles such as tin oxide particles.

<Process Cartridge and Electrophotographic Apparatus>

Figure 2:
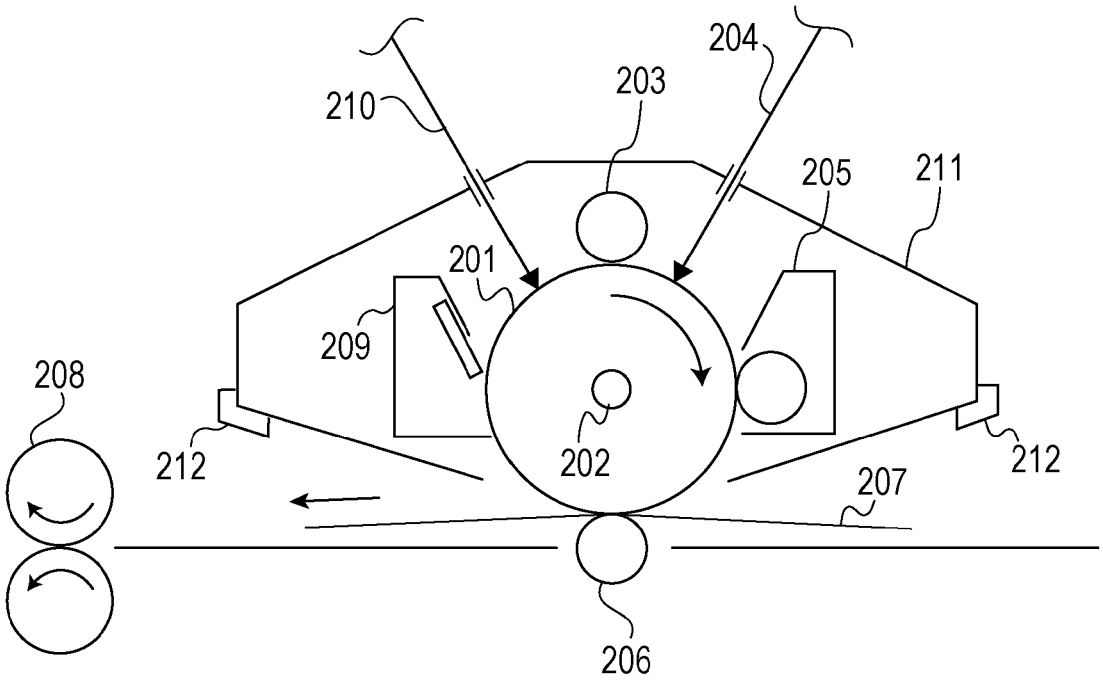
FIG. 2 illustrates an example of the schematic configuration of an electrophotographic apparatus including a process cartridge including the electrophotographic photosensitive member according to the embodiment of the present invention.

In FIG. 2, a member 201 is a cylindrical (drum-shaped) electrophotographic photosensitive member, and the electrophotographic photosensitive member is rotated around a shaft 202 in a direction indicated by an arrow at a predetermined peripheral speed (process speed).

In the rotation of the electrophotographic photosensitive member 201, the surface thereof is positively or negatively charged to predetermined potential with a charging unit 203. Then, the surface of the electrophotographic photosensitive member 201 is irradiated with an image exposure light 204 emitted from an image exposure unit (not illustrated) to form an electrostatic latent image based on intended image information. The image exposure light 204 is light which is emitted from the image exposure unit for, for example, slit exposure or exposure involving laser beam scanning and of which the intensity is adjusted on the basis of the time-sequence electric digital pixel signal of intended image information.

The electrostatic latent image formed on the surface of the electrophotographic photosensitive member 201 is developed (normal development or reversal development) with toner held inside a developing unit 205 to form a toner image on the surface of the electrophotographic photosensitive member 201. The toner image formed on the surface of the electrophotographic photosensitive member 201 is transferred to a transfer medium 207 with a transfer unit 206. In this process, a bias voltage having an opposite polarity to the charge of the toner is applied to the transfer unit 206 with a bias supply (not illustrated). In the case where the transfer medium 207 is paper, the transfer medium 207 is fed from a paper-feeding unit (not illustrated) and transported between the electrophotographic photosensitive member 201 and the transfer unit 206 in conjunction with the rotation of the electrophotographic photosensitive member 201.

The transfer medium 207 to which the toner image has been transferred from the electrophotographic photosensitive member 201 is separated from the surface of the electrophotographic photosensitive member 201 and then transported to an image-fixing unit 208. After the toner image is fixed, an image-formed article (printed article or copy) is ejected to the outside of the electrophotographic apparatus.

After the transfer of the toner image to the transfer medium 207, the surface of the electrophotographic photosensitive member 201 is cleaned with a cleaning unit 209 by removal of substances, such as toner (residual toner), adhering thereto. In recent years, a cleaner-less system has been developed, in which the residual toner can be directly removed with, for instance, a developing unit. The surface of the electrophotographic photosensitive member 201 is subjected to removal of electricity by being irradiated with pre-exposure light 210 emitted from a pre-exposure unit (not illustrated) and then repeatedly used for formation of images. In the case where the charging unit 203 is a contact charging unit in which, for example, a charging roller is used, the pre-exposure unit is not necessarily provided.

In the present invention, multiple components selected from, for instance, the electrophotographic photosensitive member 201, the charging unit 203, the developing unit 205, and the cleaning unit 209 can be integrally held in a container to form a process cartridge. Such a process cartridge can be removable from the main body of the electrophotographic apparatus. The electrophotographic photosensitive member 201 and at least one selected from the charging unit 203, the developing unit 205, and the cleaning unit 209, for example, can be integrally held to form a cartridge. In this case, a guide unit 212 such as a rail on the main body of the electrophotographic apparatus can be used to enable a process cartridge 211 removable from the main body of the electrophotographic apparatus.

In the case where the electrophotographic apparatus is a copying machine or a printer, the image exposure light 204 may be light reflected by or transmitted through a document that is to be copied or printed. Alternatively, the image exposure light 204 may be a light emitted by scanning of a laser beam, driving of an LED array, or driving of a liquid crystal shutter array which are based on signals generated from data generated by reading a document with a sensor.

<Method for Manufacturing Electrophotographic Photosensitive Member>

The electrophotographic photosensitive member of the present invention can be manufactured by forming the charge-generating layer on or above the support and then forming the charge-transporting layer on or above the charge-generating layer. In order to form charge-generating layer, a coating film of a coating liquid for the charge-generating layer is formed on or above the support, and the coating film is dried by heating. This formation of the charge-generating layer enables a fluoranthene compound to be present in the matrix of the charge-generating layer.

The fluoranthene compound present in the matrix can be confirmed by NMR analysis with the aid of a deuterated solvent which can dissolve the matrix but cannot dissolve the domain.

In particular, the fluoranthene compound can be confirmed as follows.

[NMR Analysis]

Analytical equipment: AVANCE III 500 manufactured by Bruker BioSpin K.K.

Solvent: Deuterated chloroform ($CDCL_3$)

Deuterated chloroform dissolves fluoranthene compounds and many types of binder resins, whereas not dissolving an azo pigment and phthalocyanine pigment which are charge-generating substances generally used. In other words, deuterated chloroform is a solvent which dissolve the matrix but does not dissolve the domain.

EXAMPLES

The present invention will now be described further in detail with reference to specific examples. The term "part" used below refers to "part by mass". In Examples and Comparative Examples, thickness was measured with an eddy-current film thickness meter (Fischerscope, manufactured by Fischer Instruments K.K.) or obtained by specific gravity conversion based on the mass per unit area.

Example 1

An aluminum cylinder having a diameter of 24 mm and a length of 257 mm (JIS-A 3003, aluminum alloy) was used as a support (cylindrical support).

A solution composed of the components shown in Table 1 was subjected to dispersion for approximately 20 hours in a ball mill to prepare a coating liquid for a conductive layer.

TABLE 1

| | |
|---|---|
| Powder of barium sulfate particles having layer coated with tin oxide (trade name: Passtran PC1, manufactured by MITSUI MINING & SMELTING CO., LTD.) | 60 parts |
| Titanium oxide (trade name: TITANIX JR, manufactured by Tayca Corporation) | 15 parts |
| Resol-type phenolic resin (trade name: PHENOLITE J-325, manufactured by DIC Corporation, solid content 70 mass %) | 43 parts |
| Silicone oil (trade name: SH28PA, Dow Corning Toray Co., Ltd.) | 0.015 parts |
| Silicone resin (trade name: TOSPEARL 120, Momentive Performance Materials Inc.) | 3.6 parts |
| 2-methoxy-1-propanol | 50 parts |
| Methanol | 50 parts |

The coating liquid for a conductive layer, which had been prepared in this manner, was applied onto the aluminum cylinder by immersion coating to form a coating film, and the coating film was heated at 140° C. for an hour for curing, thereby forming a conductive layer having a thickness of 15 μm. Then, a solution in which the components shown in Table 2 had been dissolved in a liquid mixture of 400 parts of methanol and 200 parts of n-butanol was applied onto the conductive layer by immersion coating to form a coating film, the coating film was heated at 100° C. for 10 minutes for drying, thereby forming an undercoat layer having a thickness of 0.45 μm.

TABLE 2

| | |
|---|---|
| Copolymer nylon resin (trade name: AMILAN CM8000, manufactured by Toray Industries, Inc.) | 10 parts |
| Methoxymethylated 6-nylon resin (trade name: Toresin EF-30T, manufactured by Nagase ChemteX Corporation) | 30 parts |

(Synthesis of Hydroxygallium Phthalocyanine Crystal)

Hydroxygallium phthalocyanine crystal was synthesized through Synthetic Examples 1 to 3.

Synthetic Example 1

Under a nitrogen atmosphere, 72 parts of o-phthalonitrile, 25 parts of gallium trichloride, and 350 parts of quinoline were allowed to react with each other at 200° C. for 4 hours, and the product was filtered at 130° C. The resulting product was dispersed in N,N-dimethylformamide at 140° C. for 2 hours for washing, subjected to filtration, washed with methanol, and then dried to produce 32 parts of chlorogallium phthalocyanine (yield: 38.0%).

Synthetic Example 2

In 300 parts of concentrated sulfuric acid at 15° C., 15 parts of the chlorogallium phthalocyanine produced in Synthetic Example 1 was dissolved. The solution was dropped into 2000 parts of iced water under stirring for reprecipitation, and the resulting solution was filtered. The filtered product was dispersed in aqueous 2% ammonia for washing, subsequently dispersed in ion-exchanged water for washing four times, and then vacuum-dried at 40° C. to produce 13 parts of hydroxygallium phthalocyanine.

Synthetic Example 3

At room temperature (24° C.), 5 parts of the hydroxygallium phthalocyanine produced in Synthetic Example 2 and 95 parts of N,N-dimethylformamide were milled with 150 parts of glass beads each having a diameter of 1 mm in a ball mill for 20 hours. The solid content of the dispersion liquid was separated, and the solid was thoroughly washed with tetrahydrofuran and then dried to produce 4.2 parts of hydroxygallium phthalocyanine crystal.

The produced hydroxygallium phthalocyanine crystal had peaks at Bragg angles 2θ±0.2° of 7.5°, 9.9°, 16.3°, 18.6°, 25.1°, and 28.3° for CuKα X-ray diffraction.

Then, the components shown in Table 3 were mixed with each other and dispersed for four hours in a sand mill in which glass beads each having a diameter of 1 mm were used, thereby preparing a dispersion liquid. To the dispersion liquid, 250 parts of ethyl acetate and 1 part of Example Compound (1) (fluoranthene compound) were added to prepare a coating liquid for a charge-generating layer.

TABLE 3

| | |
|---|---|
| Hydroxygallium phthalocyanine crystal | 10 parts |
| Polyvinyl butyral (trade name: S-LEC BX-1, manufactured by SEKISUI CHEMICAL CO., LTD.) | 5 parts |
| Calixarene compound represented by Formula (12) | 0.2 parts |
| Cyclohexane | 250 parts |

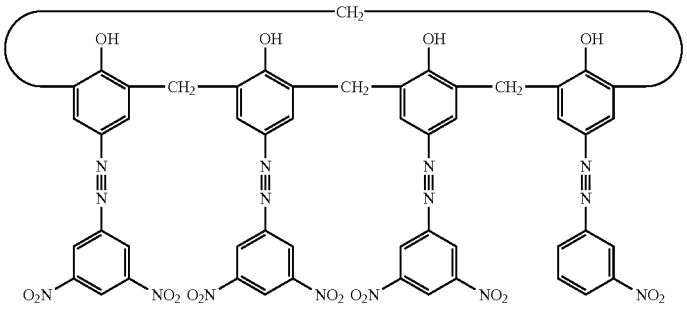

(12)

The coating liquid for a charge-generating layer, which had been prepared in this manner, was applied onto the undercoat layer by immersion coating to form a coating film, and the coating film was heated at 100° C. for 10 minutes for drying, thereby forming a charge-generating layer having a thickness of 0.20 μm.

Then, the components shown in Table 4 were dissolved in a mixed solvent of 600 parts of monochlorobenzene and 200 parts of methylal to prepare a coating liquid for a charge-transporting layer.

TABLE 4

| | |
|---|---|
| Hole-transporting compound represented by Formula (13) | 70 parts |
| Polycarbonate resin (trade name: Lupilon Z200, manufactured by Mitsubishi Engineering-Plastics Corporation) | 100 parts |

TABLE 4-continued

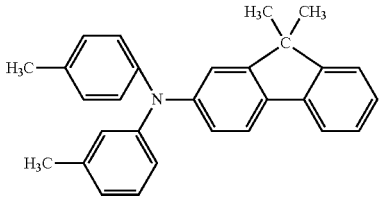

(13)

The coating liquid for a charge-transporting layer, which had been prepared in this manner, was applied onto the charge-generating layer by immersion coating to form a coating film, and the coating film was heated at 120° C. for 60 minutes for drying, thereby forming a charge-transporting layer having a thickness of 15 μm. Through these processes, a cylindrical (drum-shaped) electrophotographic photosensitive member of Example 1 had been produced.

Example 2

Except that the amount of Example Compound (1) used in the preparation of the coating liquid for the charge-generating layer in Example 1 was changed from 1 part to 3 parts, an electrophotographic photosensitive member of Example 2 was produced as in Example 1.

Example 3

Except that the amount of Example Compound (1) used in the preparation of the coating liquid for the charge-generating layer in Example 1 was changed from 1 part to 0.1 parts, an electrophotographic photosensitive member of Example 3 was produced as in Example 1.

Example 4

Except that oxytitanium phthalocyanine crystal was used in place of the hydroxygallium phthalocyanine crystal that was the charge-generating substance used in the preparation of the coating liquid for the charge-generating layer in Example 1, an electrophotographic photosensitive member of Example 4 was produced as in Example 1. The oxytitanium phthalocyanine crystal used had a crystalline form showing peaks at Bragg angles 2θ±0.2° of 9.0°, 14.2°, 23.9°, and 27.1°.

Example 5

Except that the amount of Example Compound (1) used in the preparation of the coating liquid for the charge-generating layer in Example 1 was changed from 1 part to 0.05 parts, an electrophotographic photosensitive member of Example 5 was produced as in Example 1.

Example 6

Except that the amount of Example Compound (1) used in the preparation of the coating liquid for the charge-generating layer in Example 1 was changed from 1 part to 4 parts, an electrophotographic photosensitive member of Example 6 was produced as in Example 1.

Example 7

The amounts of the hydroxygallium phthalocyanine, polyvinyl butyral, and Example Compound (1) used in the preparation of the coating liquid for the charge-generating layer in Example 1 were changed as shown in Table 5. The thickness of the charge-generating layer was changed from 0.20 μm to 0.18 μm. Except for these changes, an electrophotographic photosensitive member of Example 7 was produced as in Example 1.

Example 8

The amounts of the hydroxygallium phthalocyanine, polyvinyl butyral, and Example Compound (1) used in the preparation of the coating liquid for the charge-generating layer in Example 1 were changed as shown in Table 5. The thickness of the charge-generating layer was changed from 0.20 μm to 0.18 μm. Except for these changes, an electrophotographic photosensitive member of Example 8 was produced as in Example 1.

Example 9

The amounts of the hydroxygallium phthalocyanine, polyvinyl butyral, and Example Compound (1) used in the preparation of the coating liquid for the charge-generating layer in Example 1 were changed as shown in Table 5. The thickness of the charge-generating layer was changed from 0.20 μm to 0.27 μm. Except for these changes, an electrophotographic photosensitive member of Example 9 was produced as in Example 1.

Example 10

The amounts of the hydroxygallium phthalocyanine, polyvinyl butyral, and Example Compound (1) used in the preparation of the coating liquid for the charge-generating layer in Example 1 were changed as shown in Table 5. The thickness of the charge-generating layer was changed from 0.20 μm to 0.27 μm. Except for these changes, an electrophotographic photosensitive member of Example 10 was produced as in Example 1.

Example 11

Except that the fluoranthene compound used in the preparation of the coating liquid for the charge-generating layer was changed to Example Compound (5), an electrophotographic photosensitive member of Example 11 was produced as in Example 1.

Example 12

Except that the fluoranthene compound used in the preparation of the coating liquid for the charge-generating layer was changed to Example Compound (3), an electrophotographic photosensitive member of Example 12 was produced as in Example 1.

Example 13

Except that the fluoranthene compound used in the preparation of the coating liquid for the charge-generating layer was changed to Example Compound (10), an electrophotographic photosensitive member of Example 13 was produced as in Example 1.

Example 14

Except that the fluoranthene compound used in the preparation of the coating liquid for the charge-generating layer was changed to Example Compound (8), an electrophotographic photosensitive member of Example 14 was produced as in Example 1.

Example 15

Except that the fluoranthene compound used in the preparation of the coating liquid for the charge-generating layer was changed to Example Compound (12), an electrophotographic photosensitive member of Example 15 was produced as in Example 1.

Example 16

The fluoranthene compound used in the preparation of the coating liquid for the charge-generating layer was changed to Example Compound (12), and the amount of the fluoranthene compound was changed from 1 part to 3 parts. Except for these changes, an electrophotographic photosensitive member of Example 16 was produced as in Example 1.

Example 17

The fluoranthene compound used in the preparation of the coating liquid for the charge-generating layer was changed to Example Compound (12), and the amount of the fluoranthene compound was changed from 1 part to 0.1 parts. Except for these changes, an electrophotographic photosensitive member of Example 17 was produced as in Example 1.

Example 18

Except that the fluoranthene compound used in the preparation of the coating liquid for the charge-generating layer was changed to Example Compound (2), an electrophotographic photosensitive member of Example 18 was produced as in Example 1.

Comparative Example 1

Except that Example Compound (1) used in the preparation of the coating liquid for the charge-generating layer in Example 1 was not used, an electrophotographic photosensitive member of Comparative Example 1 was produced as in Example 1.

Comparative Example 2

In Example 1, the following <Synthetic Example 3-2> replaced <Synthetic Example 3>, and Example Compound (1) used in the preparation of the coating liquid for the charge-generating layer was added in <Synthetic Example 3-2>. Except for these changes, an electrophotographic photosensitive member of Comparative Example 2 was produced as in Example 1.

Synthetic Example 3-2

At room temperature (24° C.), 5 parts of the hydroxygallium phthalocyanine produced in Synthetic Example 2, 0.5 parts of fluoranthene that was Example Compound (1), and 95 parts of N,N-dimethylformamide were milled with 150 parts of glass beads each having a diameter of 1 mm in a ball mill for 20 hours. The solid content of the dispersion liquid was separated, and the solid was thoroughly washed with tetrahydrofuran and then dried to produce 4.2 parts of hydroxygallium phthalocyanine crystal.

The matrix of the formed charge-generating layer was subjected to the above-mentioned NMR analysis to determine the fluoranthene content therein; however, fluoranthene was not detected.

Comparative Example 3

Except that tetracyanoethylene replaced Example Compound (1) used in the preparation of the coating liquid for the charge-generating layer in Example 1, an electrophotographic photosensitive member of Comparative Example 3 was produced as in Example 1.

Comparative Example 4

Except that anthracene replaced Example Compound (1) used in the preparation of the coating liquid for the charge-generating layer in Example 1, an electrophotographic photosensitive member of Comparative Example 4 was produced as in Example 1.

Evaluation of Examples 1 to 18 and Comparative Examples 1 to 4

The electrophotographic photosensitive members of Examples 1 to 18 and Comparative Examples 1 to 4 were subjected to evaluations of a ghost image and a black-spot image at a normal temperature of 23° C. and a normal humidity of 50% RH.

In the evaluations, a laser beam printer (trade name: Color Laser Jet CP3525dn) manufactured by Hewlett-Packard Development Company, L.P. was modified and used as an evaluative electrophotographic apparatus. In particular, the laser beam printer was modified so that pre-exposure was not carried out and so that the modified laser beam printer was operated under variable charging conditions and in variable amounts of laser exposure. The produced electrophotographic photosensitive members were each attached to a process cartridge for cyan, the process cartridge was mounted on the station of the process cartridge for cyan, and the laser beam printer was allowed to be operated without process cartridges for other colors attached to the main body of the laser beam printer.

In output of an image, only the process cartridge for cyan was attached to the main body of the laser beam printer to output a unicolor image formed with cyan toner. The surface potential of the electrophotographic photosensitive member was adjusted to be −500 V at its unexposed part and to be −100 V at its exposed part. In order to measure the surface potential of the electrophotographic photosensitive member for the adjustment of potential, a potential probe (trade name: model 6000B-8, manufactured by TREK Japan KK) was attached to the develop position of the process cartridge. The potential of the electrophotographic photosensitive member at its central part in the longitudinal direction was measured with a surface electrometer (trade name: model 344, manufactured by TREK Japan KK).

The evaluation of a ghost image was carried out at a normal temperature of 23° C. and a normal humidity of 50% RH. Table 6 shows results of the evaluation. The evaluation criteria were as follows.

Figure 3:
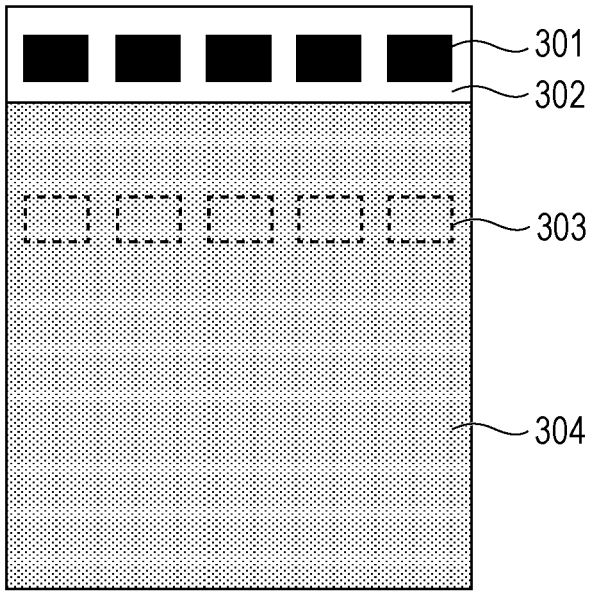
FIG. 3 illustrates an image used for evaluation of a ghost image.
Figure 4:
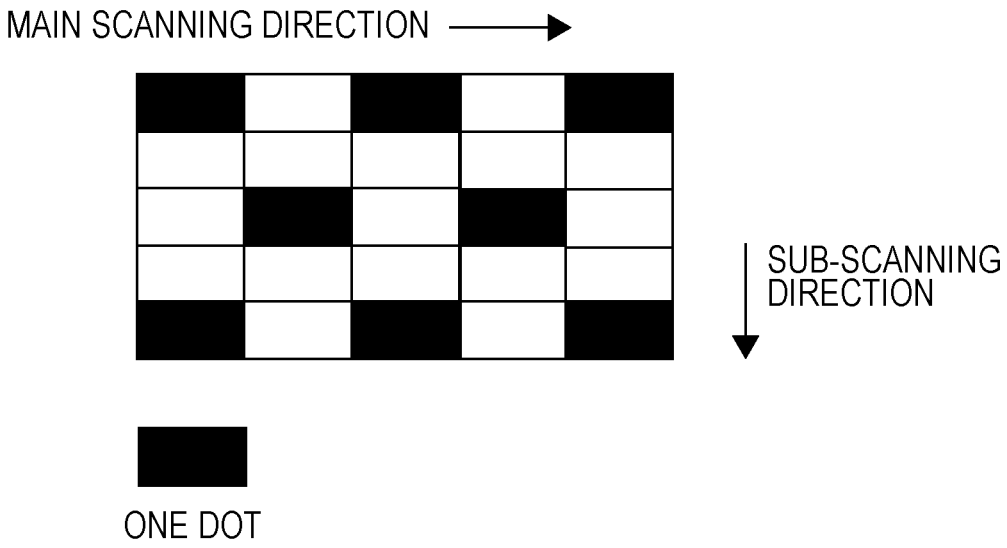
FIG. 4 illustrates a one-dot Keima (similar to knight-jump) pattern.

An image for evaluating a ghost was formed in the following manner: solid black squares 301 was output on a solid white background 302 on the head of an entire image as illustrated in FIG. 3, and then a halftone part 304 of a one-dot Keima (similar to knight-jump) pattern illustrated in FIG. 4 was output. A solid white image was output on the first sheet, the image for evaluating a ghost was subsequently continuously output on five sheets, a solid black image was subsequently output on one sheet, and then the image for evaluating a ghost was output on five sheets again, in this order; these ten images for evaluating a ghost in total were used in the evaluation.

In the evaluation of a ghost image, the difference in image density between a one-dot Keima (similar to knight-jump) pattern and a ghost region (region 303 where a ghost was likely to be generated owing to the solid black squares 301) was measured with a spectral densitometer (trade name: X-Rite 504/508, manufactured by X-Rite, Incorporated). The measurement was carried out at ten points on one image for evaluating a ghost, and the average of results of the measurement at the ten points was determined to define result of the measurement for one image. Each of the ten images for evaluating a ghost was subjected to the measurement in the same manner, and then the average of results of the measurement for the ten images was determined to define the density difference in corresponding Examples and Comparative Examples. The density difference indicates that the smaller value exhibits a lower degree of a ghost and is more favorable.

The evaluation of a black-spot image was carried out as follows: a solid white pattern was output on glossy paper, the difference in image density between unprinted glossy paper and the glossy paper on which the solid white pattern had been formed was measured with a reflection densitometer (DENSITOMETER TC-6DS, manufactured by TOKYO DENSHOKU INDUSTRIES CO., LTD.). The difference in image density was measured at ten points, and the average of the obtained values was determined. Table 6 shows results of the measurement. A smaller difference in image density between the unprinted glossy paper and the glossy paper on which the solid white pattern had been formed indicates a smaller number of black spots, which is satisfactory.

TABLE 5

| | Charge-generating substance | Fluoranthene compound | Amount of charge-generating substance (part by mass) | Amount of polyvinyl butyral (part by mass) | Amount of fluoranthene compound (part by mass) | Thickness (μm) |
|---|---|---|---|---|---|---|
| Example 1 | Hydroxygallium phthalocyanine | Example Compound (1) | 10 | 5 | 1 | 0.20 |
| Example 2 | Hydroxygallium phthalocyanine | Example Compound (1) | 10 | 5 | 3 | 0.20 |
| Example 3 | Hydroxygallium phthalocyanine | Example Compound (1) | 10 | 5 | 0.1 | 0.20 |
| Example 4 | Oxytitanium phthalocyanine | Example Compound (1) | 10 | 5 | 1 | 0.20 |
| Example 5 | Hydroxygallium phthalocyanine | Example Compound (1) | 10 | 5 | 0.05 | 0.20 |
| Example 6 | Hydroxygallium phthalocyanine | Example Compound (1) | 10 | 5 | 4 | 0.20 |
| Example 7 | Hydroxygallium phthalocyanine | Example Compound (1) | 11.25 | 3.75 | 3 | 0.18 |
| Example 8 | Hydroxygallium phthalocyanine | Example Compound (1) | 11.25 | 3.75 | 0.08 | 0.18 |
| Example 9 | Hydroxygallium phthalocyanine | Example Compound (1) | 7.5 | 7.5 | 4 | 0.27 |
| Example 10 | Hydroxygallium phthalocyanine | Example Compound (1) | 7.5 | 7.5 | 0.1 | 0.27 |
| Example 11 | Hydroxygallium phthalocyanine | Example Compound (5) | 10 | 5 | 1 | 0.20 |
| Example 12 | Hydroxygallium phthalocyanine | Example Compound (3) | 10 | 5 | 1 | 0.20 |
| Example 13 | Hydroxygallium phthalocyanine | Example Compound (10) | 10 | 5 | 1 | 0.20 |
| Example 14 | Hydroxygallium phthalocyanine | Example Compound (8) | 10 | 5 | 1 | 0.20 |
| Example 15 | Hydroxygallium phthalocyanine | Example Compound (12) | 10 | 5 | 1 | 0.20 |
| Example 16 | Hydroxygallium phthalocyanine | Example Compound (12) | 10 | 5 | 3 | 0.20 |
| Example 17 | Hydroxygallium phthalocyanine | Example Compound (12) | 10 | 5 | 0.1 | 0.20 |
| Example 18 | Hydroxygallium phthalocyanine | Example Compound (2) | 10 | 5 | 1 | 0.20 |
| Comparative Example 1 | Hydroxygallium phthalocyanine | | 10 | 5 | — | 0.20 |
| Comparative Example 2 | Hydroxygallium phthalocyanine (fluoranthene added in Synthetic Example 3) | | 10 | 5 | — | 0.20 |
| Comparative Example 3 | Hydroxygallium phthalocyanine | | 10 | 5 | 1 (tetracyanoethylene) | 0.20 |
| Comparative Example 4 | Hydroxygallium phthalocyanine | | 10 | 5 | 1 (anthracene) | 0.20 |

TABLE 6

| | Fluoranthene compound content relative to charge-generating substance (mass %) | Fluoranthene compound content relative to binder resin (mass %) | Density difference for evaluating ghost image | Density difference for evaluating black-spot image |
|---|---|---|---|---|
| Example 1 | 10 | 20 | 0.025 | 1.1 |
| Example 2 | 30 | 60 | 0.031 | 1.3 |
| Example 3 | 1 | 2 | 0.032 | 1.1 |
| Example 4 | 10 | 20 | 0.029 | 1.2 |
| Example 5 | 0.5 | 1 | 0.038 | 1.1 |
| Example 6 | 40 | 80 | 0.037 | 1.2 |
| Example 7 | 26.67 | 80 | 0.034 | 1.2 |
| Example 8 | 0.71 | 2.13 | 0.035 | 1.1 |
| Example 9 | 53.33 | 53.33 | 0.034 | 1.2 |
| Example 10 | 1.33 | 1.33 | 0.032 | 1.1 |
| Example 11 | 10 | 20 | 0.024 | 1.1 |
| Example 12 | 10 | 20 | 0.027 | 1.1 |
| Example 13 | 10 | 20 | 0.027 | 1.2 |
| Example 14 | 10 | 20 | 0.026 | 1.2 |
| Example 15 | 10 | 20 | 0.021 | 1.1 |
| Example 16 | 30 | 60 | 0.022 | 1.1 |
| Example 17 | 1 | 2 | 0.024 | 1.1 |
| Example 18 | 10 | 20 | 0.024 | 1.1 |
| Comparative Example 1 | — | — | 0.047 | 1.1 |
| Comparative Example 2 | — | — | 0.046 | 1.1 |
| Comparative Example 3 | — | — | 0.041 | 2.2 |
| Comparative Example 4 | — | — | 0.046 | 1.2 |

As is clear from Examples 1 to 18 and Comparative Examples 1 to 4, each electrophotographic photosensitive member in which the matrix of the charge-generating layer contained a fluoranthene compound enabled output of a good image with reductions in a positive ghost image and black-spot image.

In particular, since a fluoranthene compound was not used in Comparative Example 1, the density difference for evaluating a ghost image was large. In Comparative Example 2, a fluoranthene compound was used in the synthesis of hydroxygallium phthalocyanine and thus was not contained in the matrix; hence, the density difference for evaluating a ghost image was large as in Comparative Example 1. In Comparative Example 3, tetracyanoethylene was used in place of the fluoranthene compound, and the density difference for evaluating a ghost image was small as compared with Comparative Example 1 in which tetracyanoethylene and a fluoranthene compound were not used; however, the density for evaluating a black-spot image was large. In Comparative Example 4, anthracene was used in place of the fluoranthene compound, and the density difference for evaluating a ghost image was large.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-095611 filed Apr. 30, 2013 and Japanese Patent Application No. 2014-050808 filed Mar. 13, 2014, which are hereby incorporated by reference herein in their entirety.

What is claimed is:

1. An electrophotographic photosensitive member comprising:

a support;

a charge-generating layer formed on the support; and a charge-transporting layer formed on the charge-generating layer, wherein the charge-generating layer has a matrix-domain structure having:

a domain which comprises the charge-generating substance, and a matrix which comprises a binder resin and a fluoranthene compound.

2. The electrophotographic photosensitive member according to claim 1, wherein the binder resin is polyvinyl butyral.

3. The electrophotographic photosensitive member according to claim 1, wherein the charge-generating substance is a phthalocyanine pigment.

4. The electrophotographic photosensitive member according to claim 3, wherein the phthalocyanine pigment is hydroxygallium phthalocyanine crystal.

5. The electrophotographic photosensitive member according to claim 4, wherein the hydroxygallium phthalocyanine crystal has a crystalline form having peaks at Bragg angles 2θ±0.2° of 7.5 °, 9.9°, 16.3°, 18.6°, 25.1°, and 28.3° for CuKα X-ray diffraction.

6. The electrophotographic photosensitive member according to claim 1, wherein the fluoranthene compound is a compound represented by any one of Formulae (6) and (7)

(6)

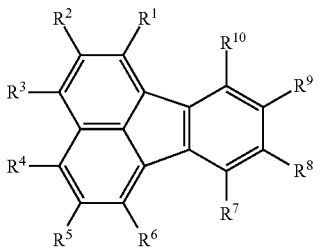

-continued (7)

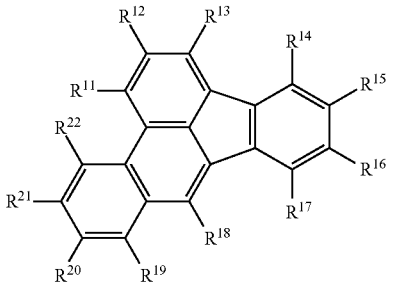

(where $R^1$ to $R^{22}$ each independently represent a hydrogen atom, a halogen atom, a nitro group, an aldehyde group, a substituted amino group, a substituted or unsubstituted alkyl group, or a substituted or unsubstituted aryl group;

the substituent of the substituted amino group is an alkyl group, an alkoxy-group-substituted alkyl group, an aryl-substituted alkyl group, a halogen-substituted alkyl group, an aryl group, an alkoxy-group-substituted aryl group, an aryl-group-substituted aryl group, or a halogen-substituted aryl group;

the substituent of the substituted alkyl group is an alkoxy group, a morpholinoalkoxy group, a dialkylamino group, an alkoxycarbonyl group, an aryl group, a halogen atom, a cyano group, or a morpholino group; and the substituent of the substituted aryl group is an alkyl group, an alkoxy group, a dialkylamino group, an alkoxycarbonyl group, a halogen atom, a nitro group, a cyano group, a formyl group, or a morpholino group).

7. The electrophotographic photosensitive member according to Claim 6, wherein the substituent of the substituted amino group is an alkyl group, an alkoxy-group-substituted alkyl group, an aryl-substituted alkyl group, or a halogen-substituted alkyl group.

8. The electrophotographic photosensitive member according to claim 1, wherein the fluoranthene compound content is in the range of 1 mass% to 30 mass% relative to the charge-generating substance content in the charge-generating layer.

9. The electrophotographic photosensitive member according to claim 1, wherein the fluoranthene compound content is in the range of 2 mass% to 60 mass% relative to the binder resin content in the charge-generating layer.

10. A process cartridge comprising:

the electrophotographic photosensitive member according to claim 1; and at least one unit selected from the group consisting of a charging unit, a developing unit, and a cleaning unit, wherein the process cartridge integrally holds the electrophotographic photosensitive member and the selected unit and is removably attached to the main body of an electrophotographic apparatus.

11. An electrophotographic apparatus comprising: the electrophotographic photosensitive member according to claim 1;

a charging unit;

an exposure unit;

a developing unit; and a transfer unit.

12. A method for manufacturing an electrophotographic photosensitive member including a support, a charge-generating layer formed on the support, and a charge-transporting layer formed on the charge-generating layer, the method comprising:

mixing a charge-generating substance, a binder resin, and a solvent with each other to prepare a dispersion liquid;

adding a fluoranthene compound to the dispersion liquid to prepare a coating liquid for the charge-generating layer; and forming the charge-generating layer through forming a coating film of the coating liquid for the charge-generating layer and then heat-drying the coating film.

* * * * *